United States Patent [19]

Nutter

[11] 4,226,699

[45] Oct. 7, 1980

[54] METHOD AND APPARATUS FOR CONSERVATION OF HEAT FROM SLUDGE PRODUCED BY A RETORT

[75] Inventor: John F. Nutter, Encino, Calif.

[73] Assignee: Tosco Corporation, Los Angeles, Calif.

[21] Appl. No.: 925,468

[22] Filed: Jul. 17, 1978

[51] Int. Cl.[2] ..... C10B 49/02; C10G 1/02

[52] U.S. Cl. ..... 208/11 R; 202/150

[58] Field of Search ..... 208/11 R, 13; 202/150

[56] References Cited

U.S. PATENT DOCUMENTS

| | | | |
|---|---|---|---|
| 2,725,347 | 11/1955 | Leffer | 208/11 R |
| 3,925,190 | 12/1975 | Whitcombe et al. | 208/11 R |

*Primary Examiner*—Herbert Levine

*Attorney, Agent, or Firm*—Poms, Smith, Lande & Rose

[57] ABSTRACT

In a process for the retorting of oil shale wherein hot flue gases containing oxygen are used for preheating the raw oil shale and wherein, additionally, a combustible sludge containing particulate matter and bottoms oil is produced, method and apparatus are disclosed for forming a combustible mixture of the sludge and the gases whereby the sludge is combusted to raise the temperature of the gases and produce only entrained particulate matter as a by-product. By so doing, the requirement for additional fuel to heat the gases to operational temperatures is reduced and the sludge is eliminated as a by-product of the process requiring separate disposal. Rather, the entrained particulate matter is removed and disposed of along with particulate matter normally produced within the process.

7 Claims, 6 Drawing Figures

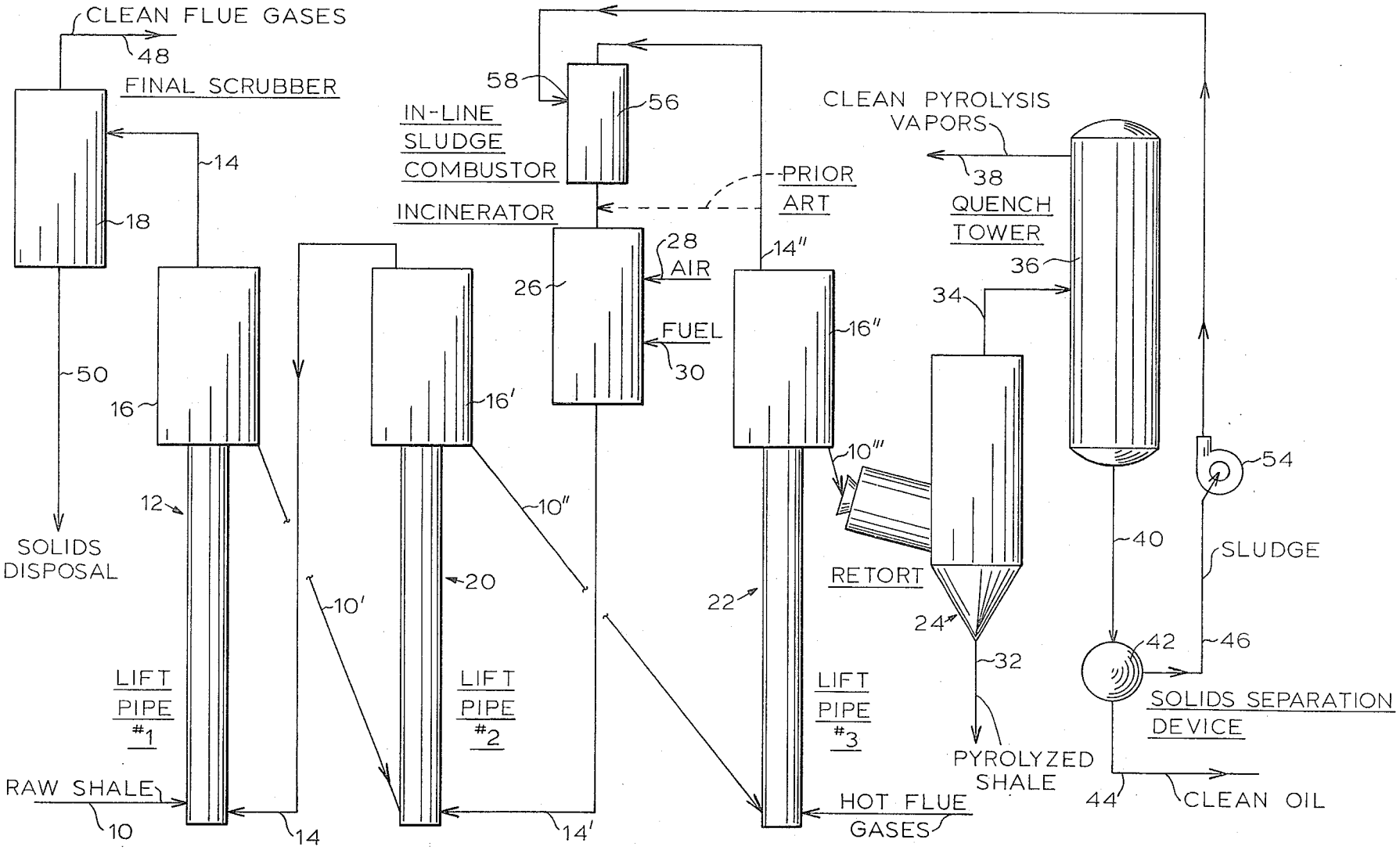
CLEAN FLUE GASES
48
FINAL SCRUBBER
18
14
50
SOLIDS DISPOSAL
16
12
LIFT PIPE #1
RAW SHALE
10
10'
14
16'
10''
20
LIFT PIPE #2
14'
58
IN-LINE SLUDGE COMBUSTOR
56
INCINERATOR
26
28
AIR
FUEL
30
PRIOR ART
14''
16''
10'''
22
LIFT PIPE #3
HOT FLUE GASES
RETORT
24
32
PYROLYZED SHALE
34
QUENCH TOWER
36
CLEAN PYROLYSIS VAPORS
38
40
42
SOLIDS SEPARATION DEVICE
44
CLEAN OIL
46
SLUDGE
54

METHOD AND APPARATUS FOR CONSERVATION OF HEAT FROM SLUDGE PRODUCED BY A RETORT

BACKGROUND OF THE INVENTION

The present invention relates to oil shale retorting processes and, more particularly, to retorting processes for the retorting of oil shale employing hot flue gases for preheating the raw oil shale.

The pyrolysis of oil shale by solid-to-solid heat transfer techniques to convert the kerogen content of oil shale into oil and other gaseous hydrocarbons is well known as exemplified by the disclosures in U.S. Pat. Nos. 3,265,608 and 3,691,056. In these prior art processes, oil shale is preheated and thereafter pyrolyzed by solid-to-solid heat transfer contact with heat-carrying bodies to produce shale oil and other effluent vapors. Upon completion of the kerogen conversion the heat-carrying bodies are recycled through a reheating zone for further use in pyrolyzing additional preheated oil shale.

In U.S. Pat. No. 3,925,190, Whitcombe, et al discloses an improvement to such processes which utilizes the residual sensible heat of the flue gases previously employed in the process to heat the heat-carrying bodies for preheating the raw oil shale prior to the pyrolysis thereof. The preheating of the crushed raw oil shale by the hot flue gases is accomplished in a series of at least two dilute phase fluidized beds, i.e. gas lift lines or lift pipes, having an incineration zone interposed therebetween through which the flue gas from the final preheat zone is passed prior to contacting and preheating additional oil shale to a temperature between that of the initial raw shale temperature and the final preheat temperature prior to introduction of the preheated shale into the pyrolysis zone. The single FIGURE sets forth in simplified form one configuration of such oil shale retorting appartus incorporating hot flue gases for the preheating of the raw oil shale.

Briefly, it can be seen that raw oil shale 10 is introduced at the bottom of a first lift pipe 12 along with hot gases 14. A dilute phase fluidized bed is thus created within the first lift pipe 12. As the raw shale 10 rises in first lift pipe 12 in the presence of the hot gases 14, it is heated. The heated raw shale 10' and hot gases 14 pass into the separator 16 of first lift pipe 12 from whence the hot gases 14 containing entrained particulate matter are passed to a final scrubber 18 and the heated raw oil shale 10' is directed to the bottom of a second lift pipe 20. In similar manner, within the second lift pipe 20 the heated shale 10' is mixed with hot gases 14' being of a hotter temperature than the hot gases 14. As can be seen, within the separator 16' of second lift pipe 20, the now hotter raw oil shale 10'' is directed to the bottom of a third lift pipe 22 while the hot gases of a lower temperature after transferring a portion of the heat therein to the shale 10' are directed to the bottom of lift pipe 12 as the hot gases 14. According to the prior art, from the third lift pipe separator 16'', the raw oil shale 10''' is directed into the retort 24 and the cooled hot gases 14'' are passed directly into an incinerator 26 as indicated by the dashed arrow connector wherein they are heated by the burning of air 28 and fuel 30 to emerge as hot gases 14' which enter the bottom of the second lift pipe 20 as hereinbefore described.

From the retort 24, the pyrolyzed shale 32 is removed as a waste product while the vapors 34 are directed into a quench tower 36. The pyrolysis vapors 34 produced in the retorting process entrain certain amounts of very fine solids or particulate matter which are removed from the bulk of the pyrolysis vapors 34 in the quench tower 36. The clean pyrolysis vapors 38 are directed to further recovery apparatus (not shown). The solids are removed as a bottoms oil mixture 40 of condensed heavy pyrolysis oil and solids. Before this heavy bottoms oil in the mixture 40 can be combined with the remainder of the oil recovered by the process or before it is further processed, installation of a centrifuge, filter, or other solids separation device 42 is desirable so that a clean bottoms oil 44 can be produced. The separation device 42 makes a clarified oil containing a low amount of solids in the oil which is drawn off as the clean oil 44 which is processed by further recovery apparatus (also not shown). Additionally, the solids separation device 42 produces a sludge 46 composed of a concentration of solids in bottoms oil. The disposal of the sludge 46 creates a disposal problem unlike the clean flue gases 48 and solids (particulate matter) 50 which are produced from the hot gases 14 emerging from first lift pipe 12 by the final scrubber 18 connected thereto. In addition, the oils contained within sludge 46, if disposed of in conjunction with sludge 46, represent a loss of potentially usable product in the recovery process.

Wherefore, it is the object of the present invention to provide method and apparatus for eliminating the sludge as a disposal problem and for utilizing the otherwise lost oils contained therein.

SUMMARY OF THE INVENTION

The foregoing objectives have been realized in oil retorting apparatus including a conduit for conducting hot flue gases containing oxygen used for preheating the raw oil shale and having a waste outlet supplying a combustible sludge comprising particulate matter and bottoms oil, by the improvement comprising a sludge combustor having an inlet and an outlet connected in-line with the conduit to cause the flue gases to flow through the combustor and further having an injector inlet connected to the waste outlet to receive the sludge, the combustor including injector means connected to the injector inlet for injecting the received sludge into the gases passing through the combustor to form a combustible mixture therein and further including means for causing the combustible mixture to combust whereby the gases are heated to an elevated temperature and the non-combusted portion of the sludge is converted to particulate matter entrained in the moving gas stream for later removal and disposal of along with other particulate matter.

As applied to the apparatus as shown in the drawing, the presently disclosed method comprises passing the flue gases through a sludge combustor prior to passing them through the incinerator; injecting the sludge into the sludge combustor to form a combustible mixture therein; and, combusting the combustible mixture to produce hot flue gases containing entrained particulate matter whereby the engery required in the incinerator to raise the gases to the desired temperature is decreased and the entrained particulate matter is disposed of along with other particulate matter produced in the process.

DESCRIPTION OF THE DRAWING

The single drawing is a simplified flow diagram of apparatus for oil retorting according to one embodiment wherein hot flue gases are used to preheat the raw oil shale prior to pyrolysis including apparatus according to the present invention for practicing the method thereof.

DESCRIPTION OF THE PREFERRED EMBODIMENT

Referring once again to the single drawing, to implement the present invention and practice the method thereof, the outlet of the solids separation device 42 is connected to the inlet of a pump 54. Further, whereas the outlet for hot gases 14'' from the third lift pipe 22 according to the prior art is connected to the input of the incinerator 26, in the present invention, a sludge combustor 56 is disposed in-line in the conduit connecting the separator 16'' of the third lift pipe 22 to the incinerator 26 through which the hot gases 14'' flow. Thus, the gases 14'' must pass through the sludge combustor 56 before entering the incinerator 26. The sludge combustor 56 includes an injector inlet 58 which is connected to the outlet of pump 54. Thus, the sludge 46 is pumped by pump 54 through the injector inlet 58 into sludge combustor 56. It has been found that the flue gases 14'' passing through the in-line sludge combustor 56 contain up to approximately five times the stoicometric amount of oxygen required for oxidation of the sludge. The sludge 46 entering through the injector inlet 58 is mixed with the oxygen-bearing flue gases 14'' to form a combustible mixture which is then combusted. The combustion process increases the temperature of the flue gases prior to entering the incinerator 26 from a temperature before the combustor 56 of 525° to 625° F. to a range of 925° to 1025° F. This higher inlet temperature entering the incinerator 26, of course, thereby reduces the amount of fuel 30 required for incineration of the flue gases to raise them to their desired temperature prior to injection at the bottom of the second lift pipe 20. In some processes, it may be possible to eliminate the incinerator 26 completely, accomplishing all heating of the flue gases by means of the sludge combustion process. It has been found that the amount of oxygen contained within the flue gases 14'' and the mass flow thereof is sufficient so as to keep the combustion temperature below the range required for significant nitrogen oxide formation. Any sulfur dioxide that is formed by the combustion of the carbon and oil of the sludge are absorbed by the basic solids in the lift pipes 12 and 20. Trace hydrocarbons that may result from the combustion within the sludge combustor 56 are oxidized in the incinerator 26. The additional solids (particulate matter) introduced with the sludge 46 are removed in the final scrubber 18 and then disposed of with the other solids 50 that have been scrubbed from the flue gases 14.

As a result, it can be seen that the additional apparatus and procedure of combusting the sludge in the presence of the oxygen-containing flue gases prior to the passing thereof through the incinerator to raise the temperature affords numerous advantages. First, the sludge 46 is eliminated as a distinct by-product requiring special handling for disposal. That portion of the sludge 46 not consumed in the combustor 56 is converted to entrained particulate matter within the flowing gases 14 to be removed in the scrubber 18. Additionally, oil recovery is increased by the amount of oil that would otherwise be consumed as fuel 30 in incinerator 26 if the sludge 46 were disposed of without burning. In a typical installation incorporating the apparatus and procedure as shown in the FIGURE for the retorting of oil shale, the increased oil recovery can amount up to approximately 1600 barrels per day of equivalent fuel requirement.

Having thus described my invention, I claim:

1. In a process wherein hot flue gases containing oxygen are used for heating oil shale in a portion of the process not requiring the oxygen and wherein clean oil, waste particulate matter, and a sludge comprising particulate matter and burnable oil are produced, the method of maximizing the energy utilization and minimizing the waste disposal problems associated with the process comprising the steps of:

(a) forming a combustible mixture of the sludge and the flue gases prior to said heating portion of the process;

(b) combusting said combustible mixture prior to said heating portion of the process to consume the burnable oil and at least a portion of the oxygen of said mixture and to produce flue gases of increased temperature and lowered oxygen content and to produce particulate matter which can be disposed of with the other particulate matter from the process; and, (c) using the increased temperature flue gases from step (b) in said heating portion of the process.

2. In the retorting of oil shale in a process wherein flue gases containing oxygen are used to preheat the raw shale prior to its introduction into the retort vessel and wherein a waste sludge comprising particulate matter and burnable oil is produced, the method of improving the energy efficiency of the process and eliminating the sludge as a disposable by-product of the process comprising the steps of:

(a) passing the gases through a sludge combustor prior to using them to preheat the raw oil shale;

(b) injecting the sludge into the sludge combustor to form a combustible mixture therein; and, (c) combusting the combustible mixture to produce hot gases containing entrained particulate matter for use in the subsequent preheating of the raw oil shale whereby the entrained particulate matter is disposed of along with other particulate matter produced in the process.

3. The improvement to a process for the retorting of oil shale as claimed in claim 2 wherein:

(a) the flue gases are passed through an incinerator to be heated by the burning of fuel and air prior to being used to preheat the shale; and, (b) said step of combusting the combustible mixture to produce hot gases is accomplished prior to passing the flue gases through the incinerator whereby the energy required in the incinerator to raise the gases to the desired temperature for preheating the raw oil shale is reduced.

4. In oil shale retorting apparatus including a conduit for conducting hot flue gases containing oxygen used for preheating the raw oil shale and having a waste outlet supplying a burnable sludge comprising particulate matter and bottom oil, the improvement for increasing the energy efficiency and eliminating the sludge as a by-product requiring separate disposal comprising:

a sludge combustor having an inlet and an outlet connected in-line with the conduit to cause the gases to flow through said combustor prior to contacting the raw oil shale and further having an injector inlet connected to the waste outlet to receive the sludge, said combustor including injector means connected to said injector inlet for injecting said received sludge into the gases passing through said combustor to form a combustible mixture and further including means for causing said combustible mixture to combust whereby the gases are heated to an elevated temperature and the non-combusted portion of the sludge is converted to particulate matter entrained in the moving gas stream for later removal and disposal of along with other particulate matter.

5. The improvement to oil shale retorting apparatus claimed in claim 4 and additionally comprising:

pump means connected between the outlet supplying the sludge and said injector inlet for receiving the sludge and delivering the sludge to said injector inlet under pressure whereby the sludge is injected into said sludge combustor in a manner to form a combustible mixture with the oxygen in the hot gases therein.

6. The improvement to oil shale retorting apparatus claimed in claim 4 wherein:

(a) the conduit includes an in-line incinerator disposed prior to the point at which the flue gases contact the raw oil shale wherein the flue gases are heated to an elevated temperature by the burning of fuel and air; and, (b) said sludge combustor is disposed in the conduit prior to the incinerator whereby the energy required in the incinerator to raise the flue gases to the desired temperature for preheating the raw oil shale is reduced.

7. In a process wherein heated gases are used for heating oil shale in a portion of the process and wherein a sludge comprising particulate matter and burnable oil are produced, the method of maximizing the energy utilization and minimizing the waste disposal problems associated with the process comprising the steps of:

(a) forming a combustible mixture of the sludge and gases prior to said heating portion of the process;

(b) combusting said combustible mixture prior to said heating portion of the process to consume the oil and at least a portion of said mixture to produce gases of increased temperature and to produce particulate matter content which can be disposed of with other particulate matter from the process; and, (c) using the increased temperature gases from step (b) in said heating portion of the process whereby the amount of energy from other sources required to raise the temperature of the gases for heating is minimized.

* * * * *